US006893296B2

(12) United States Patent
Aekins et al.

(10) Patent No.: US 6,893,296 B2
(45) Date of Patent: May 17, 2005

(54) LOW NOISE COMMUNICATION MODULAR CONNECTOR INSERT

(75) Inventors: Robert A. Aekins, Branford, CT (US); Joseph E. Dupuis, Ledyard, CT (US)

(73) Assignee: Ortronics, Inc., New London, CT (US)

( * ) Notice: Subject to any disclaimer, the term of this patent is extended or adjusted under 35 U.S.C. 154(b) by 0 days.

(21) Appl. No.: 10/810,743

(22) Filed: Mar. 25, 2004

(65) Prior Publication Data

US 2004/0235359 A1 Nov. 25, 2004

Related U.S. Application Data

(62) Division of application No. 09/968,128, filed on Oct. 1, 2001, now Pat. No. 6,802,743.

(60) Provisional application No. 60/237,755, filed on Sep. 29, 2000.

(51) Int. Cl.[7] ..... H01R 13/64

(52) U.S. Cl. ..... 439/676; 439/941

(58) Field of Search ..... 439/676, 941

(56) References Cited

U.S. PATENT DOCUMENTS

| | | | | |
|---|---|---|---|---|
| 2,741,194 | A | | 7/1956 | Beynink |
| 5,186,647 | A | | 2/1993 | Denkmann et al. |
| 5,269,708 | A | | 12/1993 | DeYoung et al. |
| 5,299,956 | A | | 4/1994 | Brownell et al. |
| 5,310,363 | A | | 5/1994 | Brownell et al. |
| 5,326,284 | A | | 7/1994 | Bohbot et al. |
| 5,341,419 | A | | 8/1994 | Ferry |
| 5,362,257 | A | | 11/1994 | Neal et al. |
| 5,399,107 | A | | 3/1995 | Gentry et al. |
| 5,414,393 | A | | 5/1995 | Rose et al. |
| 5,432,484 | A | | 7/1995 | Klas et al. |
| 5,513,065 | A | | 4/1996 | Caveney et al. |
| 5,547,405 | A | | 8/1996 | Pinney et al. |
| 5,586,914 | A | | 12/1996 | Foster, Jr., deceased et al. |
| 5,599,209 | A | | 2/1997 | Belopolsky |
| 5,618,185 | A | | 4/1997 | Aekins |
| 5,639,266 | A | | 6/1997 | Patel |
| 5,647,770 | A | | 7/1997 | Belopolsky |
| 5,674,093 | A | * | 10/1997 | Vaden ..... 439/676 |
| 5,687,478 | A | | 11/1997 | Belopolsky |
| 5,697,817 | A | | 12/1997 | Bouchan et al. |
| 5,759,070 | A | | 6/1998 | Belopolsky |
| 5,779,503 | A | | 7/1998 | Tremblay et al. |
| 5,864,089 | A | | 1/1999 | Rainal |
| 5,911,602 | A | | 6/1999 | Vaden |
| 5,913,702 | A | | 6/1999 | Garcin |
| 5,931,703 | A | | 8/1999 | Aekins |
| 5,938,479 | A | | 8/1999 | Paulson et al. |
| 6,023,200 | A | | 2/2000 | Rhee |
| 6,086,428 | A | | 7/2000 | Pharney et al. |
| 6,089,923 | A | | 7/2000 | Phommachanh |
| 6,120,329 | A | | 9/2000 | Steinman |
| 6,155,881 | A | | 12/2000 | Arnett et al. |
| 6,186,834 | B1 | | 2/2001 | Arnett et al. |
| 6,186,836 | B1 | * | 2/2001 | Ezawa et al. ..... 439/676 |
| 6,231,397 | B1 | | 5/2001 | de la Borbolla et al. |
| 6,280,256 | B1 | | 8/2001 | Belopolsky et al. |
| 6,290,546 | B1 | | 9/2001 | Pharney |
| 6,346,010 | B1 | | 2/2002 | Emplit |
| 6,361,354 | B1 | | 3/2002 | Viklund et al. |
| 6,368,144 | B2 | | 4/2002 | Viklund |
| 6,443,777 | B1 | | 9/2002 | McCurdy et al. |
| 6,579,116 | B2 | | 6/2003 | Brennan et al. |

* cited by examiner

*Primary Examiner*—Tho D. Ta
(74) *Attorney, Agent, or Firm*—McCarter & English, LLP

(57) ABSTRACT

The present disclosure is related to a modular plug housing insert device that makes electrical contact to a telecommunication plug to complete an interface media connection. The positional relationship of the conductors in the modular plug housing insert device are arranged to form a capacitance, such that the Near-end Crosstalk (NEXT) and Far End Crosstalk (FEXT) are reduced without compromising impedance.

14 Claims, 5 Drawing Sheets

Figure 1
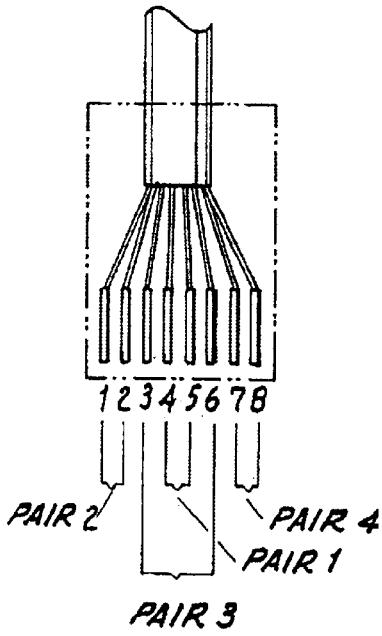
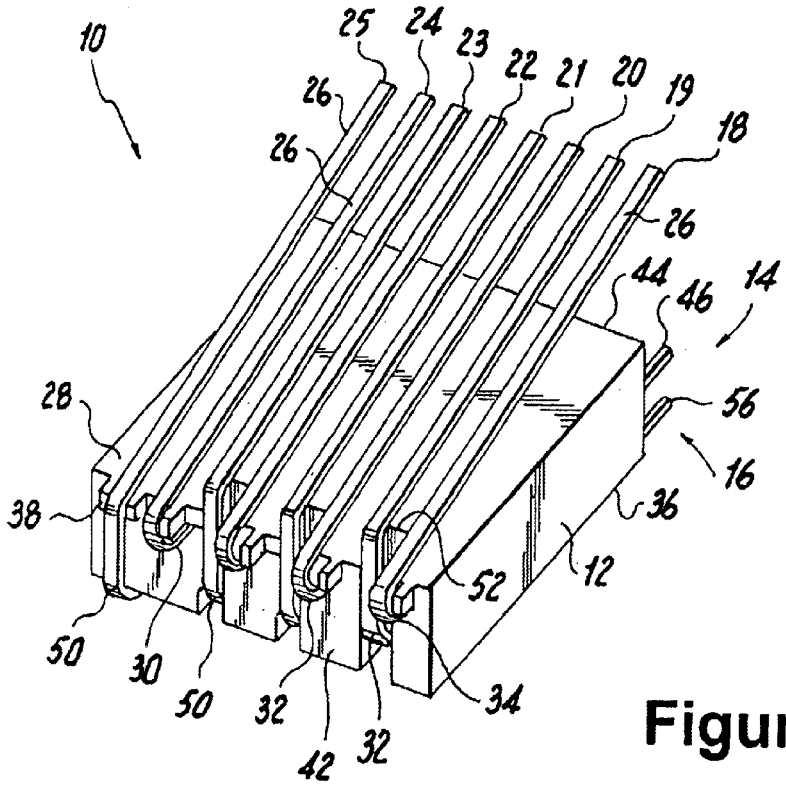
Figure 2

LOW NOISE COMMUNICATION MODULAR CONNECTOR INSERT

CROSS-REFERENCE TO RELATED APPLICATION(S)

The subject application claims the benefit of commonly owned, co-pending U.S. Provisional Application Ser. No. 60/237,755, filed Sep. 29, 2000, the disclosure of which is herein incorporated by reference.

This application is a DIV of Ser. No. 09/968,128 filed Oct. 1, 2001, now U.S. Pat. No. 6,802,743.

BACKGROUND OF THE DISCLOSURE

1. Technical Field

The present disclosure relates to devices for interfacing with high frequency data transfer media and, more particularly, to modular jack housing inserts, such as those that are used as interface connectors for Unshielded Twisted Pair ("UTP") media, that advantageously compensate for and reduce electrical noise.

2. Background Art

In data transmission, the signal originally transmitted through the data transfer media is not necessarily the signal received. The received signal will consist of the original signal after being modified by various distortions and additional unwanted signals that affect the original signal between transmission and reception. These distortions and unwanted signals are commonly collectively referred to as "electrical noise," or simply "noise." Noise is a primary limiting factor in the performance of a communication system. Many problems may arise from the existence of noise in connection with data transmissions, such as data errors, system malfunctions and/or loss of the intended signals.

The transmission of data, by itself, generally causes unwanted noise. Such internally generated noise arises from electromagnetic energy that is induced by the electrical energy in the individual signal-carrying lines within the data transfer media and/or data transfer connecting devices, such electromagnetic energy radiating onto or toward adjacent lines in the same media or device. This cross coupling of electromagnetic energy (i.e., electromagnetic interference or EMI) from a "source" line to a "victim" line is generally referred to as "crosstalk."

Most data transfer media consist of multiple pairs of lines bundled together. Communication systems typically incorporate many such media and connectors for data transfer. Thus, there inherently exists an opportunity for significant crosstalk interference.

Crosstalk can be categorized in one of two forms. Near end crosstalk, commonly referred to as NEXT, arises from the effects of near field capacitive (electrostatic) and inductive (magnetic) coupling between source and victim electrical transmissions. NEXT increases the additive noise at the receiver and therefore degrades the signal to noise ratio (SNR). NEXT is generally the most significant form of crosstalk because the high-energy signal from an adjacent line can induce relatively significant crosstalk into the primary signal. The other form of crosstalk is far end crosstalk, or FEXT, which arises due to capacitive and inductive coupling between the source and victim electrical devices at the far end (or opposite end) of the transmission path. FEXT is typically less of an issue because the far end interfering signal is attenuated as it traverses the loop.

Characteristics and parameters associated with electromagnetic energy waves can be derived by Maxwell's wave equations. In unbounded free space, a sinusoidal disturbance propagates as a transverse electromagnetic wave. This means that the electric field vectors are perpendicular to the magnetic field vectors lying in a plane perpendicular to the direction of the wave. As a result, crosstalk generally gives rise to a waveform shaped differently than the individual waveform(s) originally transmitted.

Unshielded Twisted Pair cable or UTP is a popular and widely used type of data transfer media. UTP is a very flexible, low cost media, and can be used for either voice or data communications. In fact, UTP is rapidly becoming the de facto standard for Local Area Networks ("LANs") and other in-building voice and data communications applications. In a UTP, a pair of copper wires generally form the twisted pair. For example, a pair of copper wires with diameters of 0.4–0.8 mm may be twisted together and wrapped with a plastic coating to form a UTP. The twisting of the wires increases the noise immunity and reduces the bit error rate (BER) of the data transmission to some degree. Also, using two wires, rather than one, to carry each signal permits differential signaling to be used. Differential signaling is generally more immune to the effects of external electrical noise.

The non-use of cable shielding (e.g., a foil or braided metallic covering) in fabricating UTP generally increases the effects of outside interference, but also results in reduced cost, size, and installation time of the cable and associated connectors. Additionally, non-use of cable shielding in UTP fabrication generally eliminates the possibility of ground loops (i.e., current flowing in the shield because of the ground voltage at each end of the cable not being exactly the same). Ground loops may give rise to a current that induces interference within the cable, interference against which the shield was intended to protect.

The wide acceptance and use of UTP for data and voice transmission is primarily due to the large installed base, low cost and ease of new installation. Another important feature of UTP is that it can be used for varied applications, such as for Ethernet, Token Ring, FDDI, ATM, EIA-232, ISDN, analog telephone (POTS), and other types of communication. This flexibility allows the same type of cable/system components (such as data jacks, plugs, cross-patch panels, and patch cables) to be used for an entire building, unlike shielded twisted pair media ("STP").

At present, UTP is being used for systems having increasingly higher data rates. Since demands on networks using UTP systems (e.g., 100 Mbit/s and 1200 Mbit/s transmission rates) have increased, it has become necessary to develop industry standards for higher system bandwidth performance. Systems and installations that began as simple analog telephone service and low speed network systems have now become high speed data systems. As the speeds have increased, so too has the noise.

The ANSI/TIA/EIA 568A standard defines electrical performance for systems that utilize the 1 to 100 MHz frequency bandwidth range. Exemplary data systems that utilize the 1–100 MHz frequency bandwidth range include IEEE Token Ring, Ethernet10Base-T and 100Base-T. EIA/TIA-568 and the subsequent TSB-36 standards define five categories, as shown in the following Table, for quantifying the quality of the cable (for example, only Categories 3, 4, and 5 are considered "datagrade UTP").

TABLE

| Category | Characteristic specified up to (MHz) | Various Uses |
|---|---|---|
| 1 | None | Alarm systems and other non-critical applications |
| 2 | None | Voice, EIA-232, and other low speed data |
| 3 | 16 | 10BASE-T Ethernet, 4-Mbits/s Token Ring, 100BASE-T4, 100VG-AnyLAN, basic rate ISDN. Generally the minimum standard for new installations. |
| 4 | 20 | 16-Mbits/s Token Ring. Not widely used. |
| 5 | 100 | TP-PMD, SONet, OC-3 (ATM), 100BASE-TX. The most popular for new data installations. |

Underwriter's Laboratory defines a level-based system, which has minor differences relative to the EIA/TIA-568's category system. For example, UL requires the characteristics to be measured at various temperatures. However, generally (for example), UL Level V (Roman numerals are used) is the same as EIA's Category 5, and cables are usually marked with both EIA and UL rating designations.

UTP cable standards are also specified in the EIA/TIA-568 Commercial Building Telecommunications Wiring Standard, including the electrical and physical requirements for UTP, STP, coaxial cables, and optical fiber cables. For UTP, the requirements currently include:

Four individually twisted pairs per cable

Each pair has a characteristic impedance of 100 Ohms+/−15% (when measured at frequencies of 1 to 16 MHz)

24 gauge (0.5106-mm-diameter) or optionally 22 gauge (0.6438 mm diameter) copper conductors are used Additionally, the EIA/TIA-568 standard specifies the color coding, cable diameter, and other electrical characteristics, such as the maximum cross-talk (i.e., how much a signal in one pair interferes with the signal in another pair—through capacitive, inductive, and other types of coupling). Since this functional property is measured as how many decibels (dB) quieter the induced signal is than the original interfering signal, larger numbers reflect better performance.

Category 5 cabling systems generally provide adequate NEXT margins to allow for the high NEXT associated with use of present UTP system components. Demands for higher frequencies, more bandwidth and improved systems (e.g., Ethernet 1000Base-T) on UTP cabling, render existing systems and methods unacceptable. The TIA/EIA category 6 draft addendum related to new category 6 cabling standards illustrates heightened performance demands. For frequency bandwidths of 1 to 250 MHz, the draft addendum requires the minimum NEXT values at 100 MHz to be −39.9 dB and −33.1 dB at 250 MHz for a channel link, and −54 dB at 100 MHz and −46 dB at 250 MHz for connecting hardware. Increasing the bandwidth for new category 6 (i.e., from 1 to 100 MHz in category 5 to 1 to 250 MHz in category 6) increases the need to review opportunities for further reducing system noise.

The standard modular jack housing is configured and dimensioned so as to provide maximum compatibility and matability between various manufacturers, e.g., based on the FCC part 68.500 mechanical dimension. Two types of offsets have been produced from the FCC part 68.500 modular jack housing dimensions.

Type one is the standard FCC part 68.500 style for modular jack housing and such standard housing does not add or include any compensation methods to reduce crosstalk noises. The standard modular jack housing utilizes a straightforward design approach and, by alignment of lead frames in a relatively uniform, parallel pattern, high NEXT and FEXT are produced for certain adjacent wire pairs.

This type one or standard FCC part 68.500 style of modular jack housing connector is defined by two lead frame section areas. The first section is the matable area for electrical plug contact and section two is the output area of the modular jack housing. Section one aligns the lead frames in a relatively uniform, parallel pattern from lead frame tip to the bend location that enters section two, thus producing high NEXT and FEXT noises. Section two also aligns the lead frames in a relatively uniform, parallel pattern from lead frame bend location to lead frame output, thus producing and allowing additional high NEXT and FEXT noises.

There have been approaches that are intended to reduce the crosstalk noises associated with these type one or standard modular jack housings. For example, U.S. Pat. No. 5,674,093 to Vaden et al. discloses an electrical connector having an irregular bend in one lead frame of each pair. The irregular bend reduces the parallelism of the lead frames to contribute to reductions in potential coupling effects. Although crosstalk noise may be reduced, forming lead frames as disclosed in the Vaden '093 patent is a complex process and the return loss and differential impedance in the circuit is disadvantageously increased for all four pairs.

The second type of modular jack housing is the standard FCC part 68.500 style for modular jack housings that incorporate compensation methods to reduce crosstalk noises. For example, U.S. Pat. No. 5,639,266 to Stewart discloses a compensation approach for modular jack housings that involves aligning the lead frames of the opposite pairs in an uniformed parallel pattern to removed crosstalk noises. The Stewart connector is defined by two lead frame section areas, section one being the matable area for electrical plug contact and section two being the output area of the modular jack housing. Stewart's section one aligns two lead frames, namely, positions 3 and 5 out of 8, in an uniformed and reversed signal parallel pattern from lead frame tip to the bend location that enters section two, thus reducing crosstalk noises by signal compensation. Section two also aligns the lead frames in an uniformed parallel pattern from lead frame bend location to lead frame stagger array output, which minimizes NEXT, but due to the imbalances of the center wire pairs 1 and 3, FEXT noises are disadvantageously increased according to the Stewart '266 design.

Another example of crosstalk compensation methodology is disclosed in U.S. Pat. No. 5,647,770 to Berg and U.S. Pat. No. 5,779,503 to Nordx/CDT. These two patents disclose compensation approaches for modular jack housings that involve aligning and re-bending the lead frames of the opposite pairs in an uniformed parallel pattern to contribute to crosstalk noise reduction. The Berg and Nordx/CDT devices utilize de facto standard rear entry pin positions of 0.1 inch separation for all pair arrays after the deformation of the wire pairs. The re-bending of lead frames as disclosed by the Berg '770 and Nordx/CDT '503 patents is an expensive process and the crosstalk reductions addressed by these disclosures occur mainly within the second section of their respective designs. Another method for crosstalk noise reduction and control in connecting hardware is addressed in commonly assigned U.S. Pat. No. 5,618,185 to Aekins, the disclosure of which is hereby incorporated by reference.

In view of the increasing performance demands being placed on UTP systems, e.g., the implementation of category 6 standards, it would be beneficial to provide a device and/or methodology that reduces NEXT and FEXT noises associated with standard FCC part 68.500 modular jack housings in a simple and cost effective manner. These and other objectives are achieved through the advantageous insert devices and systems disclosed herein.

SUMMARY OF THE DISCLOSURE

The present disclosure provides a modular plug dielectric insert device for a data/voice communication system modular jack housing that advantageously reduces NEXT and FEXT.

In another aspect of the present disclosure, a modular plug dielectric insert device is disclosed that is particularly adapted for being seated in a data/voice communication system modular jack housing that will reduce signal delay from the plugs input to the IDC terminal outputs to better control NEXT and FEXT of a connecting hardware.

In addition, a modular jack dielectric insert device for data/voice systems is provided that will not deform the wire pairs in a standard EIA T568B style wire configuration and is simple, low cost and easy to implement into a modular housing. Preferred lead frame wires according to the present disclosure are simple in form, but are precisely bent in proper direction(s) to reduce noise and re-balance the signal pairs in a simple and low cost manner, without reducing the impedance characteristics of the wire pairs.

Devices and/or systems according to the present disclosure include an insert in the data signal transmission media plug receiving space of a modular housing. The insert is preferably composed of a dielectric support member having a plurality of pairs of electrically conductive elongated members. Each elongated member generally includes a contact portion which is exposed in the receiving space of the modular housing for making electrical contact with the media plug contacts and a rear portion with an arcuate portion between. The contact and rear portions are in a positional relationship with respect to each other that substantially reduces and/or removes electrical noise. Thus, a capacitance is formed by the adjacency and/or degree of separation of the members which advantageously compensates for electrical noise during transmission of a signal.

In one aspect in accordance with the present disclosure, the plurality of pairs of elongated members have substantially multilaterally symmetrical portions and substantially multilaterally asymmetrical portions.

In another aspect in accordance with the present disclosure, the contact portions of the elongated conductive members are substantially multilaterally symmetrical and the rear portions are substantially multilaterally asymmetrical.

In another aspect in accordance with the present disclosure, the contact portions are substantially parallel.

In another aspect in accordance with the present disclosure, each pair of the plurality of pairs of elongated members includes a ring member and a tip member. The ring and tip members may be separated so that the ring members are on the same plane, that is, in one row, and the tip members are in another row. Preferably, these rows of conductors are spaced apart.

In another aspect in accordance with the present disclosure, the curved portions of the elongated members are substantially U-shaped, that is, they divide the elongated member into a contact portion and rear portion which extend substantially in the same direction.

Preferably, the disclosed insert is used in a modular jack for receiving and compensating a signal transmitted through the eight leads from a standard RJ45 wire plug. The EIA T568B has eight positions numbered 1–8 which are paired as follows: 1–2 (pair 2), 3–6 (pair 3), 4–5 (pair 1), 7–8 (pair 4). For the EIA T568B or T568configurations of category 5 and 6 UTP cabling (and most others), there are also eight positions. Thus, there are eight elongated conductive elements disposed on the dielectric support member. Again, each element has a contact portion for establishing electrical contact with one of the eight leads. Each rear portion extends beyond the insert for connecting to another component or device for further transmission of the signal. These conductive elements are advantageously arranged in a positional relationship with respect to each other for forming a capacitance to compensate electrical noise during transmission of the signal. This advantageous positional relationship may involve positioning the contact portions of the eight conductive elements in a substantially parallel alignment along a longitudinal axis, and having the rear portions include parallel portions as well as portions transverse to the longitudinal axis.

An arrangement for compensating cross-talk noise in an electrical signal is also disclosed herein, such arrangement including a dielectric modular jack housing having a signal transmission media receiving space for signal transmission media having a plurality of conductive members, such as a UTP cable and plugs. The plurality of pairs of elongated conductors are disposed in the signal transmission media receiving space. Each elongated conductor has a contact portion for mating with the signal transmission media and a back end portion that includes an extension for connecting with a terminal on a printed circuit board ("PCB"). The PCB may have multiple terminals for connecting with other electrically conductive media, such as a UTP cable. In accordance with the present disclosure, the plurality of pairs of elongated conductors are in a positional relationship with respect to each other to form a capacitance for compensating electrical noise in a signal transmission. The positional relationship may involve the contact portions being substantially parallel with respect to each other along a longitudinal axis and/or the back end portions being partially parallel and partially transverse with respect to the axis.

The electrical noise may be reduced by the positional relationship which advantageously results in a combination of dual and separate signal feedback reactances. The reactances in the insert device compensate for pair to pair NEXT, FEXT and impedance in a simple and cost effective unit solution.

These and other unique features of the systems, devices and methods of the present disclosure will become more readily apparent from the following description of the drawings taken in conjunction with the detailed description of preferred and exemplary embodiments.

BRIEF DESCRIPTION OF THE DRAWINGS

So that those having ordinary skill in the art to which the subject disclosure appertains will more readily understand how to construct and employ the subject disclosure, reference may be had to the drawings wherein:

FIG. 1 is a view of a RJ45 plug illustrating the standard arrangement of the RJ45 plug contacts.

FIG. 2 is a perspective view of an exemplary insert device constructed in accordance with the present disclosure.

Figure 3:
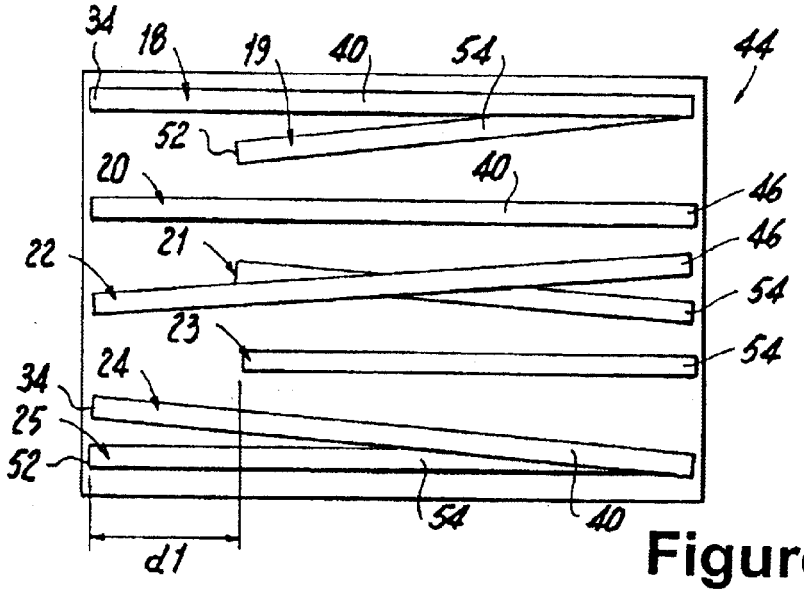
FIG. 3 is bottom plan view of the exemplary embodiment of the present disclosure depicted in FIG. 2.

These and other features of the method of the subject disclosure will become more readily apparent to those having ordinary skill in the art from the following detailed description of preferred and exemplary embodiments.

DETAILED DESCRIPTION OF PREFERRED EMBODIMENT(S)

The following detailed description of preferred and/or exemplary embodiments of the present disclosure is intended to be read in the light of, or in context with, the preceding summary and background descriptions. Unless otherwise apparent, or stated, directional references, such as "up", "down", "left", "right", "front" and "rear", are intended to be relative to the orientation of a particular embodiment of the disclosure as shown in the first numbered view of that embodiment. Also, a given reference numeral should be understood to indicate the same or a similar structure when it appears in different figures.

A significant portion and, in many instances, a majority of the coupled noise associated with the standard EIA RJ45 T568B plug arises from the adjacency of the paired arrangements. On a relative basis, the worst case NEXT noise in a RJ45 plug is a balance coupled negative noise, meaning the noise is coupled equally upon the adjacent pairs. Thus, with reference to FIG. 1, the worst effect in a four pair RJ45 plug module is typically exhibited in plug contacts numbered as 3, 4, 5 and 6, corresponding to pairs 1 and 3. The other pairs of a RJ45 plug also typically create noise problems, but such problems are of significantly lesser magnitude because only one wire of the pair is the noise source.

Referring now to FIGS. 2–12, which illustrate an exemplary embodiment of a modular insert 10, constructed in accordance with the present disclosure, a dielectric body 12 is depicted with an upper row 14 and lower row 16 of eight lead frames 18, 19, 20, 21, 22, 23, 24 and 25, constructed of an electrically conductive material and correctly spaced to mate with an RJ45 plug. The eight lead frames 18–25 are in accordance with most standard wiring formations, such as the T568B and T568A style RJ45 plugs. The TIA/EIA commercial building standards have defined category 5e and 6 electrical performance parameters for higher bandwidth (100 up to 250 MHz) systems. In category 5e and 6, the TIA/EIA RJ45 wiring style is the preferred formation and is generally followed throughout the cabling industry.

Lead frames 18–25 have contact portions 26 which each touch one of the eight RJ45 plug contacts when mated together. Frames 18, 20, 22 and 24 correspond with plug contacts 1, 3, 5 and 7, and are used for tip (i.e., positive voltage) signal transmission. Lead frames 19, 21, 23 and 25 correspond with plug contacts 2, 4, 6 and 8 on the RJ45 plug and are used for ring (i.e., negative voltage) signal transmission. Accordingly, the mating between pairs in the RJ45 plug and insert 10 is as shown below:

TABLE

| RJ45 plug pair | Insert 10 lead frames |
|---|---|
| 1 | 21 and 22 |
| 2 | 18 and 19 |
| 3 | 20 and 23 |
| 4 | 24 and 25 |

For upper row lead frames 18, 20, 22 and 24, contact portions 26 are extended above the upper surface 28 of body 12 at an angle 30 with respect to the plane of upper surface 28. Preferably, angle 30 ranges from about 15 to about 60 degrees, and is more preferably about 30 degrees when insert 10 is mated with the RJ45 plug. Contact portions 26 connect to a curved portion 32 which enters body 12 at receiving ports 34 located between upper surface 28 and the lower surface 36 of body 12. Curved portions 32 in the upper row lead frames 18, 20, 22 and 24 are generally supported by support notches 38 disposed on body 12 adjacent to the interior of curved portions 32. A rear portion 40 connects with curved portions 32. Rear portions 40 extend through body 12 from the front end 42 to the rear end 44, and include a connecting portion 46 which extends a short distance from rear end 44.

For lower row lead frames 19, 21, 23 and 25, contact portions 26 are extended above the upper surface of body 12. Contact portions 26 for lead frames 19, 21 and 23 are at an angle 48 with respect to the plane of upper surface 28. Preferably, angle 48 ranges from about 30 degrees to about 75 degrees, and more preferably, is about 40 degrees when insert 10 is mated with the RJ45 plug. Lead frame 25 is preferably at an angle substantially the same as angle 30. Lower row lead frames have extended and generally curved portions 50 which substantially direct the lead frames around the entire front end 42 at receiving ports 52. Curved portions 50 direct the lead frames back into body 12 and have rear portions 54 that extend through body 12 and have a connecting portion 56 which extends a short distance from rear end 44.

Figure 4:
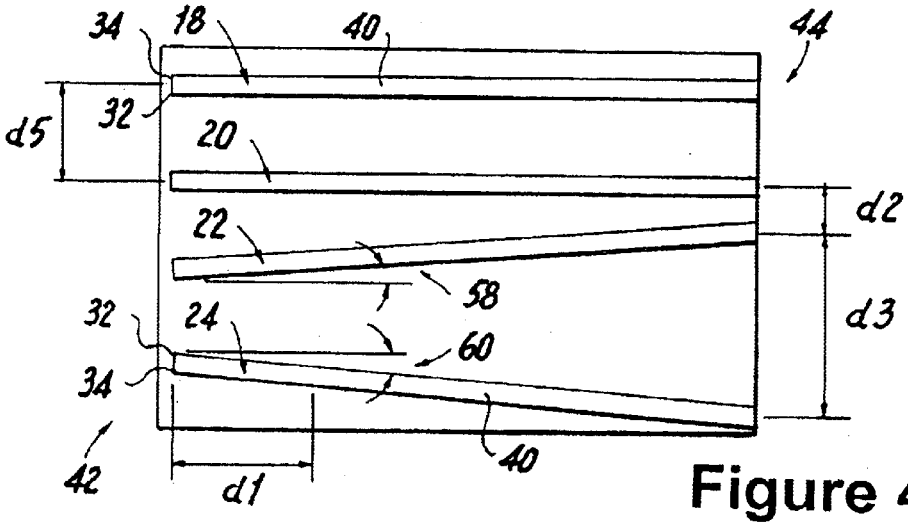
FIG. 4 is a bottom plan view of the upper row lead frames of the exemplary embodiment of the present disclosure depicted in FIG. 2.
Figure 5:
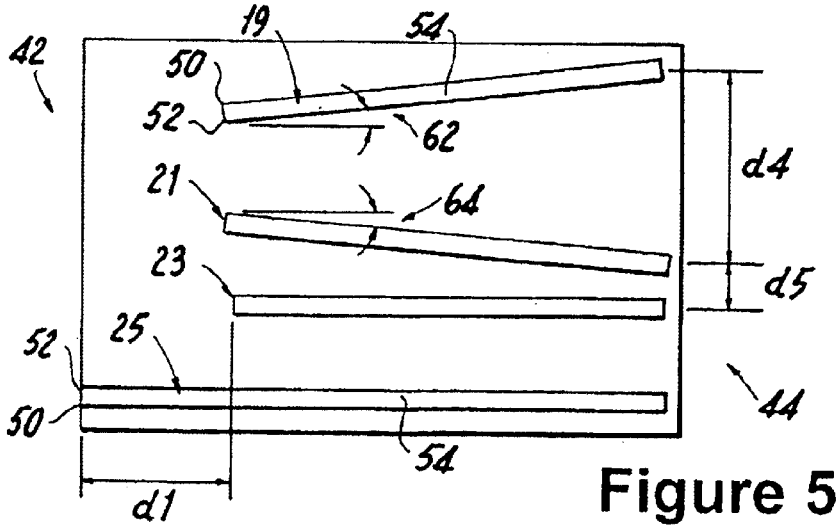
FIG. 5 is a bottom plan view of the lower row lead frames of the exemplary embodiment of the present disclosure depicted in FIG. 2.
Figure 8:
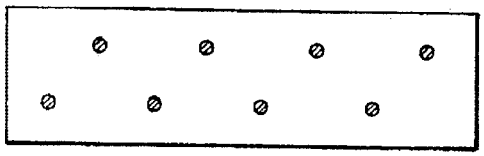
Figure 8 (Prior Art)
FIG. 8 is a back view of the rear end of a prior insert device.
Figure 9:
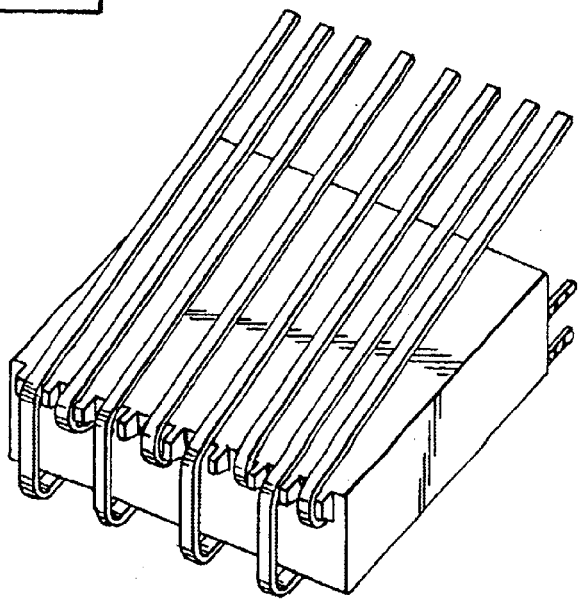
Figure 9 (Prior Art)
FIG. 9 is a perspective view of the prior insert device.
Figure 10:
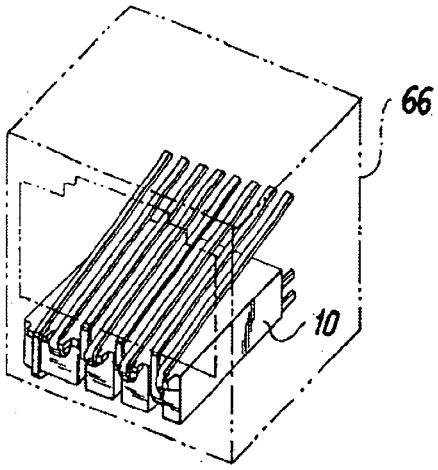
FIG. 10 is a perspective view of the exemplary embodiment of the present disclosure depicted in FIG. 2 inside a modular plug housing.
Figure 11:
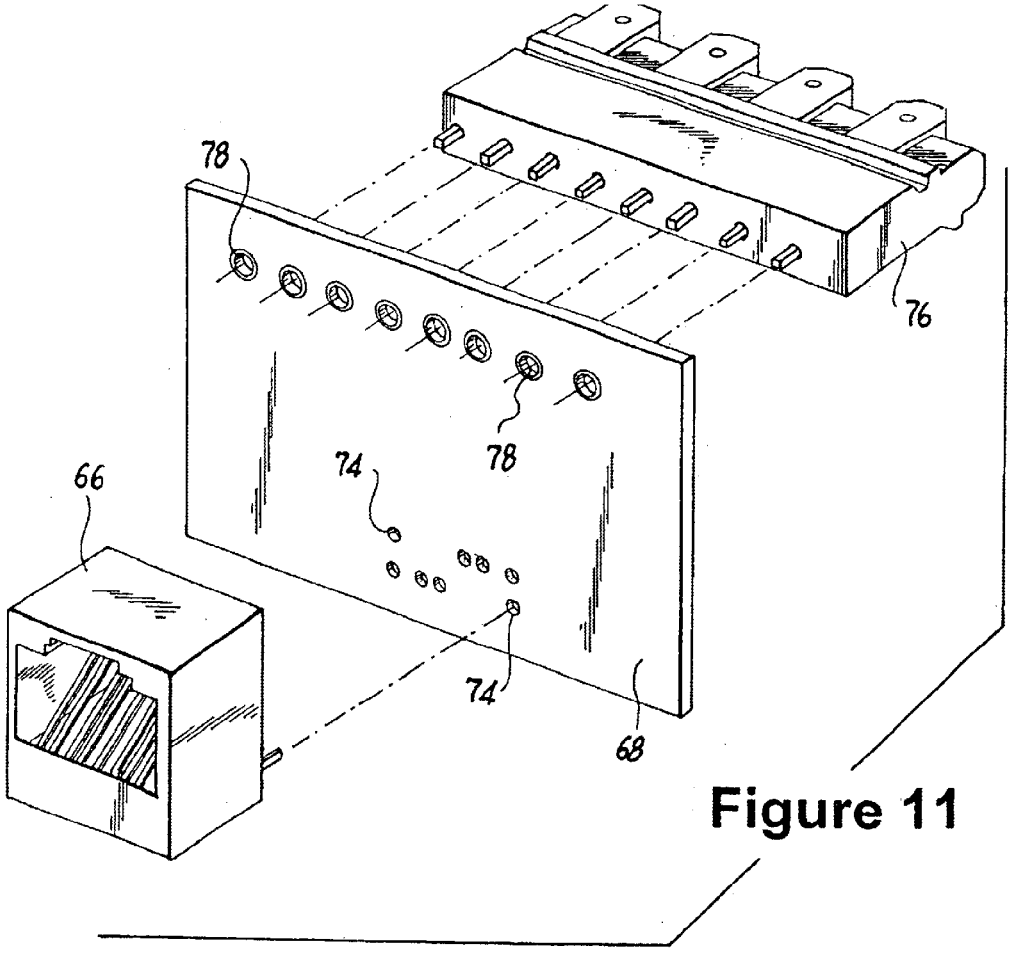
FIG. 11 is a perspective view of the exemplary connection of an insert fabricated in accordance with the present disclosure with other components.
Figure 12:
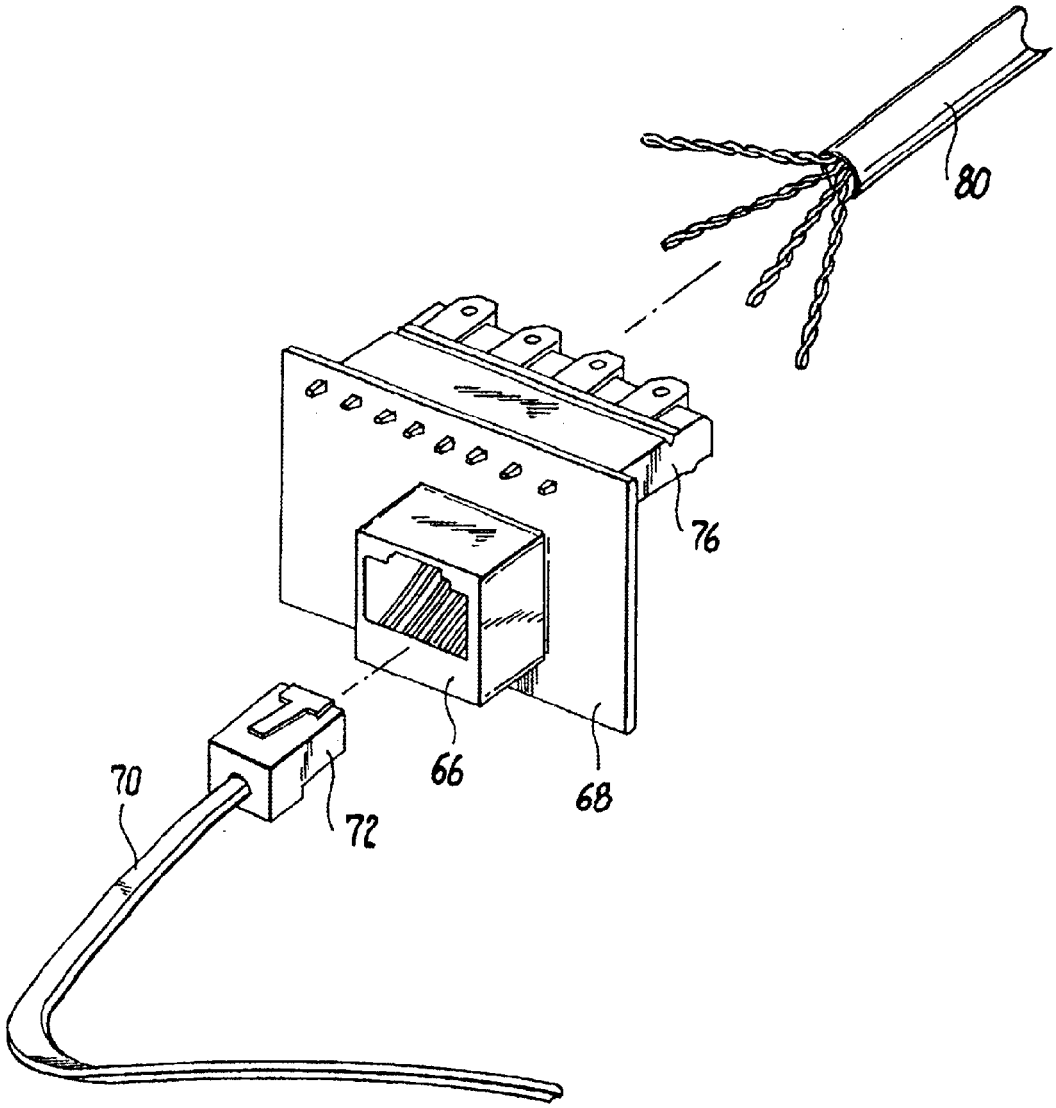
FIG. 12 is a perspective view of the exemplary arrangement of components used with the inserts fabricated in accordance with the present disclosure.

Curved portions 32 in upper row lead frames 18, 20, 22 and 24 enter into receiving ports 34 which are closer to front end 42 than curved portions 50 in lower row lead frames 19, 21 and 23 enter receiving ports 52, as may be observed with greater clarity in FIGS. 3–5. Preferably, this distance, as shown by d1, ranges from about 0.05 inches to about 0.1 inches, and is more preferably about 0.07 inches or greater. Curved portion 50 in lead frame 25 enters its receiving port 50 at substantially the same point relative front end 42 as the upper row lead frames. When comparing insert 10 with prior inserts like that which is shown in FIGS. 8 and 9, it can be observed most clearly in FIG. 7 that shifting lead frames by distance d1 in insert 10 serves to remove the parallelism between rows of lead frames, and thus, minimize unwanted noise caused by parallelism of the lead frames, among other things. Also, contact portions 26 are substantially parallel with respect to others in the same row, but rear portions 40 and 54 of lead frames 18–25 are offset and in a positional relationship with respect to each other, even in the same row, to reduce unwanted noise, among other things, which differs from the arrangement of prior inserts. In the prior art, the lead frames are parallel to each other from the plug contact area as well as inside the dielectric insert area. The prior lead frame arrangement produces unwanted NEXT and FEXT noises because of the adjacency of the like signal polarities.

Referring now to FIG. 4, only the rear portions 40 of the upper row lead frames 18, 20, 22 and 24 are shown. Lead frame 22 is at an angle 58 with respect to the longitudinal axis of contact portion 26 or frame 20, so that it exits rear end 44 closer to frame 20. The distance ds between each frame 18–25 at front end 42 is typically approximately 0.040 inches. The distance d2 between frame 20 and 22 at rear end 44 ranges from about 0.06 inches to less than 0.04 inches. Preferably, angle 58 ranges from about 5 to about 10 degrees, and more preferably is about 7 degrees. The effect of the angle increases the positive signal capacitance coupling by approximately 0.15 pF, and increases the positive signal inductance coupling by approximately 4.2 nH, among other things. The combined effective reactance is balanced against the negative induced reactance that was introduced by the RJ45 plug interface connection. Introducing a balancing opposite reactance's vectors approximately within 0.21 of the RJ45 plug noise reactance's vectors improves the offset phases that are optimal for unwanted noise removal.

Frame 24 is at an angle 60 with respect to the longitudinal axis of contact portion 26, but in the negative direction when compared to angle 58, so that frame 24 exits rear end 44 further away from frame 22. Preferably, angle 60 ranges from about 5 to about 10 degrees, and is more preferably about 7 degrees. The distance d3 between lead frame 24 and frame 22 at rear end 44 ranges from about 0.06 to about 0.3 inches, and more preferably is about 0.2 inches. The effect of angle 60 decreases the positive signal capacitance coupling by approximately 0.5 pF, and reduces the positive signal inductance coupling by approximately 1 nH. The separation of frames 22 and 24 aids in the re-balancing of the RJ45 plug effective reactance for noise reduction. Thus, noise is re-balanced by frames 18, 20, 22 and 24 inside insert 10 without the implementation of special wire contact forming bends.

Referring now to FIG. 5, which depicts the rear portions 54 for lead frames 19, 21, 23 and 25 only, it can be clearly observed that rear portions 54 are offset with respect to each other. In particular, frame 19 is at an angle 62 with respect to the longitudinal axis of contact portion 26 so that it exits rear end 44 further from frame 21 then at front end 42. Preferably, angle 62 ranges from about 5 to about 10 degrees, and is more preferably about 7 degrees. The effect of angle 62 increases the positive signal capacitance coupling by approximately 0.14 pF, and increases the positive signal inductance coupling by approximately 3.9 nH. The combined effective reactance is balanced against the negative induced reactance that was introduced by the RJ45 plug interface connection.

Frame 21 is at an angle 64 with respect to the longitudinal axis of contact portion 26, but in the negative direction when compared to angle 62, so that frame 21 exits rear end 44 further away from frame 19. Preferably, angle 64 ranges from about 5 to about 10 degrees, and is more preferably about 7 degrees. The effect of angle 64 decreases the positive signal capacitance coupling by approximately 0.3 pF, and reduces the positive signal inductance coupling by approximately 0.7 nH. By offsetting frame 19 away from frame 21, the RJ45 plug effective reactance is re-balanced which reduces noise, among other things. Preferably, the distance d4 between frame 19 and frame 21 at rear end 44 ranges from about 0.06 to about 0.3 inches, and more preferably is about 0.2 inches. Preferably, the distance d5 between frames 21 and 23 ranges from about 0.06 inches to less than 0.04 inches. Thus, noise is also re-balanced by frames 19, 21, 23 and 25 inside body 12 of insert 10 without the implementation of special wire contact forming bends.

Typical "worst case" NEXT data for the preferred embodiment of the present disclosure is greater than −45 dB and FEXT is typically greater than −44.dB. The prior art, shown in FIG. 9, dielectric insert worst case NEXT is typically −37 dB and the FEXT is typically −40 dB. Thus, insert 10 constructed in accordance with the present disclosure reduces the (differential noise) input voltage ratio signal by roughly 50 percent.

Figure 6:
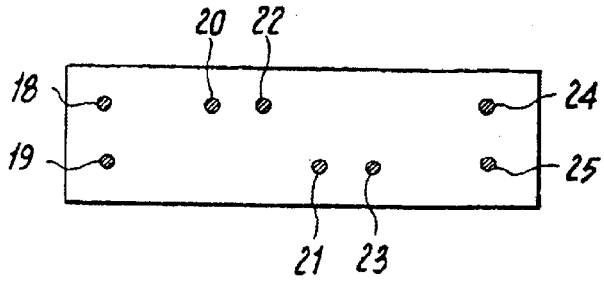
FIG. 6 is a back view of the rear end of the exemplary embodiment of the present disclosure depicted in FIG. 2.
Figure 7:
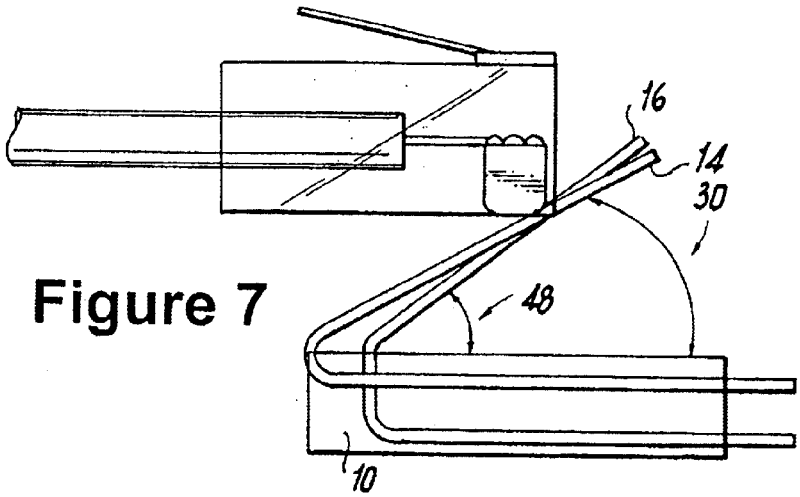
FIG. 7 is a side view of the exemplary embodiment of the present disclosure depicted in FIG. 2 being mated with a standard RJ45 plug.

FIG. 6 illustrates a view of rear end 44 of insert 10. Upper row 141 ad frames are at least about 0.1 inch above lower row 16 lead frames. When compared with the rear end of prior insert devices as shown in FIG. 8, it can clearly be observed that the two frames 21 and 23 of upper row 14 are laterally offset with respect to the two frames 20 and 22 flower row 16 while the prior insert frames are evenly spaced from each other, so at the horizontal distance between lead frames 18 and 20 of the lower row 16 is preferably about 0.1 inches, the horizontal distance between frames 20 and 22 thereof is preferably about 0.05 inches, and the horizontal distance between frames 22 and 24 thereof is preferably about 0.2 inches. Whereas, the horizontal distance between frames 19 and 21 of the upper row 14 is preferably about 0.2 inches, the horizontal distance between frames 21 and 23 thereof is preferably about 0.05 inches, and the horizontal distance between frames 23 and 25 thereof is preferably about 0.1 inches. In contrast, the prior insert device exhibits the same horizontal distances between all lead frames of about 0.1 inches each.

FIGS. 10–13 illustrate an example of insert 10 in use. Insert 10 is secured in modular housing 66 of a standard type used in a multitude of conventional electronic applications, such as for connecting to a network wall outlet, computer, or other data transfer device, which has slotted sections that allow insert 10 to be mechanically assembled with housing 66 and contact an RJ45 plug. Modular housing 66 with insert 10 is electrically connected to a printed circuit board ("PCB") 68 which may also contain signal transmission traces and/or extra coupling circuitry for re-balancing signals. Signals transfer from UTP cable 70 and into insert 10 through RJ45 type plug 72 via plug contacts 1–8, which make electrical contact substantially at contact portions 26 on lead frames 18–25. The signal transfers from insert 10 via extensions 46 and 56 of rear portions 40 and 54, respectively, into PCB 68 via PCB contacts 74. The signal is transferred from PCB 68 to insulation displacement contacts ("IDC") 76 via contact holes 78. IDC 76 is connected to a second UTP cable 80, thus completing the data interface and transfer through insert 10.

By reducing the parallelism of the lead frames at their contact portions and rear portions, lower capacitive and inductive coupling will occur as the frequency increases up to 250 MHz. The advantageous end result is an insert device that has lower NEXT, FEXT and impedance in certain wire pairs. The reduction of a majority of crosstalk noise occurs by combining indirect and direct signal coupling in the lead frames associated with central pairs 1 and 3, as well as the other pairs 2 and 4 in the RJ45 plug. Negative noise that was introduced is counter coupled with positive noise, thereby reducing the total noise effects and re-balancing the wire pairs output.

The additive positive noise and reduction of the unwanted negative noise coupling of the lead frame wires work at precisely the same moment in time, which allows optimal reduction for lower capacitive and inductive coupling. The combination of the split signals provides an enhanced low noise dielectric modular housing for high speed telecommunication connecting hardware systems, among other things. The advantageous end result is a modular insert device that has lower NEXT, FEXT and impedance within its wire pairs.

Thus, the present disclosure provides a system, device and method for reducing crosstalk noise without requiring new equipment or expensive re-wiring. The victim crosstalk noise is substantially eliminated by a combination of the appropriately placed positive feedback signal reactance circuitry and by utilizing a noise balancing dual reactance dielectric insert. This operation is accomplished by forming the appropriate contacts within the dual reactance dielectric insert for noise reduction. By using the dual reactance dielectric insert, the amount of unwanted signals can be induced to cancel that which was injected by the plug input, thus increasing the system's signal to noise ratio and reducing the network's bit error rate.

This method and system approach provides a more laboratory controlled product than other crosstalk reduction designs, which greatly improves design time, efficiency and cost. This method and system approach also provides a way to effectively remove crosstalk in a very small amount of printed circuit board space as compared to conventional crosstalk reduction designs.

Signal noise is re-balanced by the offsetting change in lead frame design, i.e., from a parallel to asymmetrical or almost perpendicular relationship between respective lead frames in the dielectric insert before the signal enters into the PCB. Exemplary devices in accordance with the present disclosure have a typical NEXT value of no greater than −46 dB and a FEXT value that is typically no greater than −50 dB. A standard modular insert typically exhibits a NEXT value of −37 dB and the FEXT is typically −40 dB. An insert device according to the present disclosure thus reduces the differential noise input voltage ratio signal by greater than fifty percent.

Although the disclosed systems, devices and methods have been described with respect to preferred embodiments, it is apparent that modifications and changes can be made thereto without departing from the spirit and scope of the invention as defined by the appended claims.

What is claimed is:

1. An insert for positioning in a data signal transmission media plug receiving space of a modular housing, comprising:

a dielectric support member operatively associated with a number of conductive members, said conductive members being arranged into at least two vertically aligned row separated by a predefined vertical distance, each conductive member having a contact portion exposed in the receiving space for making electrical contact with a media plug contact, a curve portion and a rear portion, wherein at least two inner lead frames of a first row are laterally offset with respect to at least two inner lead frames of a second row while the respective outer lead frames of the first and second rows remain vertically aligned.

2. An insert as recited in claim 1, wherein the contact portions are substantially parallel.

3. An insert as recited in claim 1, wherein at least two of the conductive members have rear portions which are directed way from each other.

4. An insert as recited in claim 1, wherein the rear portions extend from the support member.

5. An insert as recited in claim 1, wherein the number of conductive members have substantially multilaterally symmetrical portions and substantially multilaterally asymmetrical portions.

6. An insert as recited in claim 5, wherein the contact portions are substantially multilaterally symmetrical and the rear portions are substantially multilaterally asymmetrical.

7. An insert as recited in claim 1, wherein each conductive member has a ring member and a tip member.

8. An insert as recited in claim 7, wherein each row has at least four conductive members.

9. An insert in a modular jack for receiving and compensating a signal transmitted through the eight leads from a standard RJ45 wire plug, comprising:

a dielectric support member; and eight conductive elements disposed on the support member, each conductive element having a contact portion for establishing electrical contact with one of the eight leads, and a rear portion extending from the support member connecting another signal transmission device, wherein the conductive elements are arranged into at least two vertically aligned rows separated by a predefined vertical distance, at least two inner conductive elements of a first row being laterally offset with respect to at least two inner conductive elements of a second row while the respective outer conductive elements of the first and second rows remain vertically aligned, wherein this positional relationship forms a capacitance to compensate electrical noise during transmission of the signal.

10. An insert as recited in claim 9, further comprising an arcuate portion between the rear and contact portions.

11. An insert as recited in claim 9, wherein the contact portions of the eight conductive elements are in a substantially parallel positional relationship along a longitudinal axis.

12. An insert as recited in claim 11, wherein the rear portions include parallel portions and transverse portions with respect to the longitudinal axis.

13. An insert as recited in claim 9, wherein four of the eight conductive elements are ring voltage and the other four of the eight conductive elements are tip voltage.

14. An insert as recited in claim 13, wherein the ring elements are disposed in the first row and the tip elements are disposed in the second row, wherein the first row connecting devices are below the second row connecting devices.

* * * * *